US008070312B2

(12) United States Patent
Verfuerth et al.

(10) Patent No.: US 8,070,312 B2
(45) Date of Patent: Dec. 6, 2011

(54) FLUORESCENT LIGHT FIXTURE WITH LAMP CATCHER

(75) Inventors: Neal R. Verfuerth, Plymouth, WI (US); Kenneth J. Wetenkamp, Plymouth, WI (US); Brandon J. King, Manitowoc, WI (US)

(73) Assignee: Orion Energy Systems, Inc., Manitowoc, WI (US)

( * ) Notice: Subject to any disclaimer, the term of this patent is extended or adjusted under 35 U.S.C. 154(b) by 405 days.

(21) Appl. No.: 12/484,043

(22) Filed: Jun. 12, 2009

(65) Prior Publication Data

US 2009/0303722 A1 Dec. 10, 2009

Related U.S. Application Data

(63) Continuation-in-part of application No. 11/555,680, filed on Jan. 1, 2006, now Pat. No. 7,563,006, which is a continuation-in-part of application No. 29/210,513, filed on Aug. 2, 2004, now abandoned.

(51) Int. Cl.
*F21V 15/00* (2006.01)
*F21S 8/04* (2006.01)

(52) U.S. Cl. ..... 362/217.05; 362/217.08; 362/217.11; 362/225; 362/376; 362/457

(58) Field of Classification Search ..... 362/217.05, 362/217.07, 217.08, 217.09, 217.11, 217.15, 362/225, 20, 376–378, 391, 396, 457; 248/50
See application file for complete search history.

(56) References Cited

U.S. PATENT DOCUMENTS

| | | | | |
|---|---|---|---|---|
| 790,337 | A | | 5/1905 | Adams |
| D123,825 | S | | 12/1940 | Trilling |
| D130,996 | S | | 1/1942 | Chidsey |
| 2,304,445 | A | | 12/1942 | Doane |
| 2,403,240 | A | | 7/1946 | Sawin |
| 2,448,236 | A | | 8/1948 | Schneiderman et al. |
| 2,509,109 | A | * | 5/1950 | Pretzer ..... 362/216 |
| 2,636,977 | A | | 4/1953 | Foster |
| 2,687,516 | A | | 8/1954 | Schneiderman |
| 3,149,223 | A | * | 9/1964 | Zimmerman ..... 362/217.05 |
| 3,172,608 | A | | 3/1965 | Ausman |
| 3,194,958 | A | | 7/1965 | Schneiderman |

(Continued)

FOREIGN PATENT DOCUMENTS

JP 3-159612 A 7/1991

OTHER PUBLICATIONS

"Metal Scan Plates & Accessories", product listing, *LDB Manufacturing Inc.*, 2002 (1 pg.).

*Primary Examiner* — Alan Cariaso
(74) *Attorney, Agent, or Firm* — Foley & Lardner LLP

(57) ABSTRACT

A fluorescent lamp tube catcher formed of bent wire can be detachably engaged with a light fixture, with the central portion of the lamp tube catcher positioned below fluorescent tubes in the light fixture during use. In the event that a fluorescent lamp tube inadvertently becomes loose in the light fixture, the fluorescent lamp tube catcher can stop the loose fluorescent lamp tube from falling. The fluorescent lamp tube catcher can be loosely retained on the light fixture, for example while replacing a fluorescent lamp tube that has failed.

20 Claims, 16 Drawing Sheets

U.S. PATENT DOCUMENTS

| | | | | | |
|---|---|---|---|---|---|
| 3,210,538 | A | | 10/1965 | Picha et al. | |
| 3,305,102 | A | | 2/1967 | Saphirstein | |
| 3,337,035 | A | | 8/1967 | Pennybacker | |
| 3,935,560 | A | | 1/1976 | Dorn | |
| D246,827 | S | | 1/1978 | Crawford | |
| 4,101,107 | A | | 7/1978 | Antoszewski | |
| 4,229,780 | A | | 10/1980 | Nelson | |
| 4,387,417 | A | | 6/1983 | Plemmons et al. | |
| 4,514,793 | A | | 4/1985 | Andreasen | |
| D283,786 | S | | 5/1986 | Chap | |
| 4,737,895 | A | * | 4/1988 | Silver | 362/225 |
| 4,779,293 | A | | 10/1988 | Dabney et al. | |
| D300,804 | S | | 4/1989 | Myers | |
| 4,924,365 | A | * | 5/1990 | Bogdanovs | 362/225 |
| 5,001,614 | A | | 3/1991 | Buss | |
| D317,858 | S | | 7/1991 | Hoskinson et al. | |
| 5,075,832 | A | | 12/1991 | Pace | |
| 5,193,903 | A | | 3/1993 | Anisfield | |
| 5,369,558 | A | | 11/1994 | Munz | |
| 5,690,425 | A | | 11/1997 | Knoll, Jr. | |
| D393,132 | S | | 3/1998 | Baker | |
| 6,241,365 | B1 | * | 6/2001 | Cook et al. | 362/217.11 |
| 6,254,049 | B1 | | 7/2001 | Goehly | |
| 6,530,681 | B2 | | 3/2003 | Sieczkowski | |
| 6,644,836 | B1 | | 11/2003 | Adams | |
| 2002/0008975 | A1 | | 1/2002 | Uedono et al. | |
| 2002/0172049 | A1 | | 11/2002 | Yueh | |
| 2003/0179577 | A1 | | 9/2003 | Marsh | |

* cited by examiner

FLUORESCENT LIGHT FIXTURE WITH LAMP CATCHER

CROSS-REFERENCE TO RELATED PATENT APPLICATIONS

The present Application claims the benefit of priority as a continuation-in-part of co-pending U.S. patent application Ser. No. 11/555,680 titled "Fluorescent Lamp Catcher" filed on Nov. 1, 2006, which claims priority as a continuation-in-part to U.S. Design patent application Ser. No. 29/210,513, filed Aug. 2, 2004, the disclosures of which are hereby incorporated by reference in their entirety.

FIELD

This invention relates generally to the field of fluorescent lighting, and more specifically to safety devices for fluorescent lighting.

BACKGROUND

Fluorescent light fixtures, for example of the sort described in U.S. Pat. No. 6,585,396, the disclosure of which is incorporated by reference, include one or more fluorescent lamps formed as elongated tubes. For a variety of reasons, these elongated fluorescent lamp tubes can become loose and drop out of the light fixture. This can present a hazard to persons and property below.

What is needed is an elegant and cost-effective device to catch a fluorescent lamp which becomes loose before it falls out of a light fixture. What is further needed is such a device to catch a fluorescent lamp, where the device can be applied to or removed from the light fixture without the use of tools. What is further needed is such a device to catch a fluorescent lamp, where the device can be unmounted from the light fixture while still loosely retained by the light fixture, for example to prevent the device from falling when replacing the fluorescent lamp tube.

SUMMARY

A first embodiment of a fluorescent light fixture with lamp tube catcher includes a first frame portion supporting at least one first lamp socket and a second frame portion supporting at least one second lamp socket. At least one reflector defining a longitudinal axis extends between the first frame portion and the second frame portion, and is configured to reflect light emitted from a fluorescent lamp tube extending between the first lamp socket and the second lamp socket. A first lip extends substantially along the length of the reflector on a first side of the light fixture and a second lip extends substantially along the length of the reflector on a second side of the light fixture. An elongated wire member has a first end defining a first hook and a second end defining a second hook, with the first hook slidably coupled to the reflector along the first lip and the second hook slidably coupled to the reflector along the second lip, so that the elongated wire member may be disposed at any one of a plurality of locations along the length of the reflector.

A second embodiment of a fluorescent light fixture with lamp tube catcher includes a first frame portion supporting at least one first lamp socket, the first frame portion having a first side with a first threaded member and a second side with a second threaded member, and a second frame portion supporting at least one second lamp socket. At least one reflector defining a longitudinal axis extends between the first frame portion and the second frame portion, and is configured to reflect light emitted from a fluorescent lamp tube extending between the first lamp socket and the second lamp socket. An elongated wire member has a first end defining a first loop removably supported by the first threaded member and a second end defining a second loop removably supported by the second threaded member, with the elongated wire member including a central portion extending between the first end and the second end and configured to support the fluorescent lamp tube in the event that the fluorescent lamp tube disengages from the first lamp socket.

A third embodiment of a fluorescent light fixture with lamp tube catcher includes a first frame portion having a first side and a second side, and supporting at least one first lamp socket, and a second frame portion having a first side and a second side and supporting at least one second lamp socket. At least one reflector defining a longitudinal axis extends between the first frame portion and the second frame portion, and is configured to reflect light emitted from a fluorescent lamp tube extending between the first lamp socket and the second lamp socket, and a lip extends substantially along the length of at least one side of the reflector. A first elongated wire member extends substantially parallel to the longitudinal axis and has a first end coupled to the first end of the first frame portion and a second coupled to the second end of the second frame portion. A second elongated wire member has a first end defining a loop disposed about the first elongated wire member for slidable engagement along the length of the first elongated wire member, and a second end defining a hook slidably coupled to the reflector along the lip, so that the second elongated wire member may be disposed at any one of a plurality of locations between the first frame portion and the second frame portion.

Other aspects of the invention relate to kits that include at least a fluorescent light fixture and a fluorescent lamp catcher, and also to methods that use a fluorescent lamp catcher, such as a method of changing a fluorescent lamp. Further objects, features, and advantages of the invention will be apparent from the following detailed description when taken in conjunction with the accompanying drawings.

DETAILED DESCRIPTION

Figure 1:
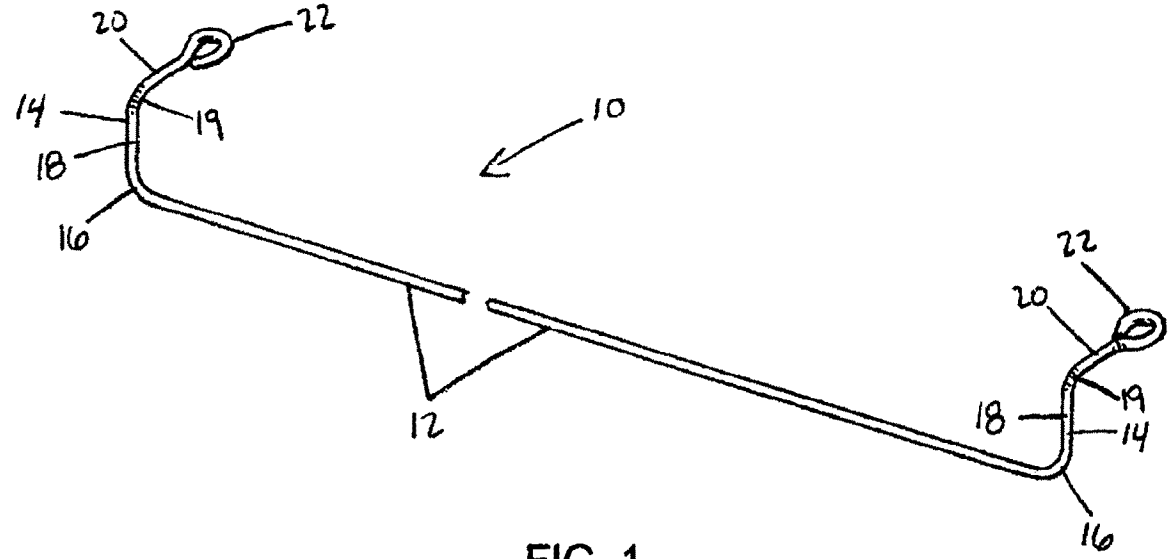
FIG. 1 is a perspective front view of a first embodiment of a fluorescent lamp catcher according to the invention.
Figure 2:
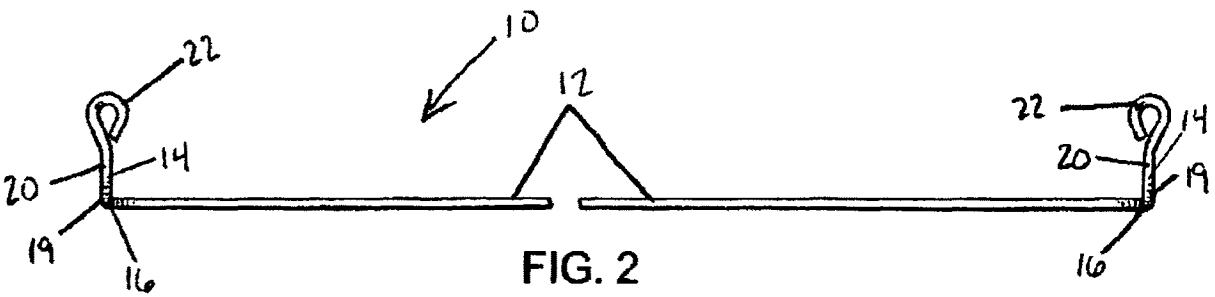
FIG. 2 is a top view of the fluorescent lamp catcher of FIG. 1.
Figure 3:
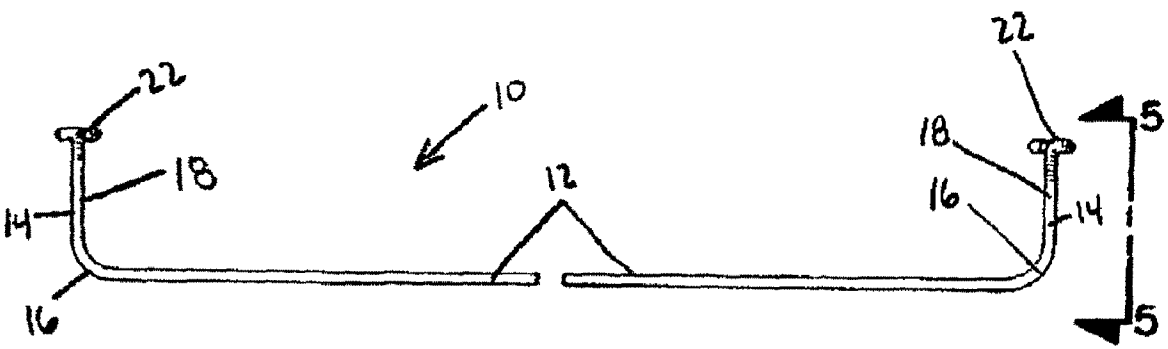
FIG. 3 is a front view of the fluorescent lamp catcher of FIG. 1.
Figure 4:
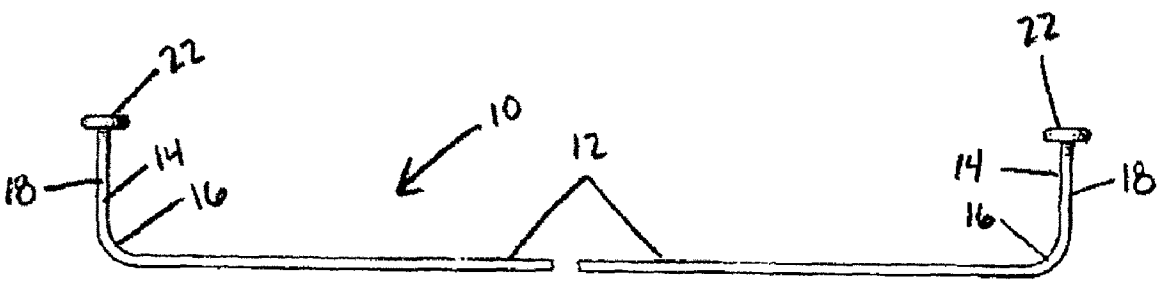
FIG. 4 is a rear view of the fluorescent lamp catcher of FIG. 1.
Figure 5:
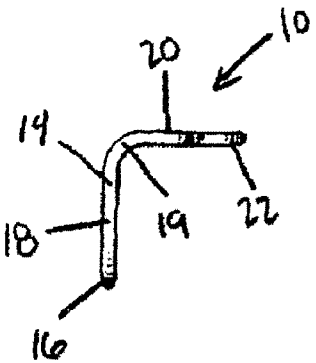
FIG. 5 is a side view of the fluorescent lamp catcher of FIG. 1.

FIGS. 1-5 provide various views of a first embodiment of a fluorescent lamp catcher (also known as a fluorescent tube catcher or light tube catcher), indicated generally at 10. The light tube catcher 10 includes a central portion 12 between two lateral portions 14. In the light tube catcher 10, each lateral portion 14 includes a first bend 16, a vertical portion 18, a second bend 19, a lengthwise portion 20, and a mounting portion 22 formed as a loop. This particular structure is not required, and different structures could be used with different light fixture structures. It is not necessary that the mounting portion 22 forms an entire loop, a portion of a loop could be used at one or both ends.

The light tube catcher 10 is preferably formed by bending a unitary piece of metal wire of appropriate length into the desired shape, as this can be a particularly cost-effective method. However, this is not required and other materials and methods of construction could be used. For example, a molded plastic or other synthetic part could be used, or a part formed of multiple pieces could be used.

Figure 6:
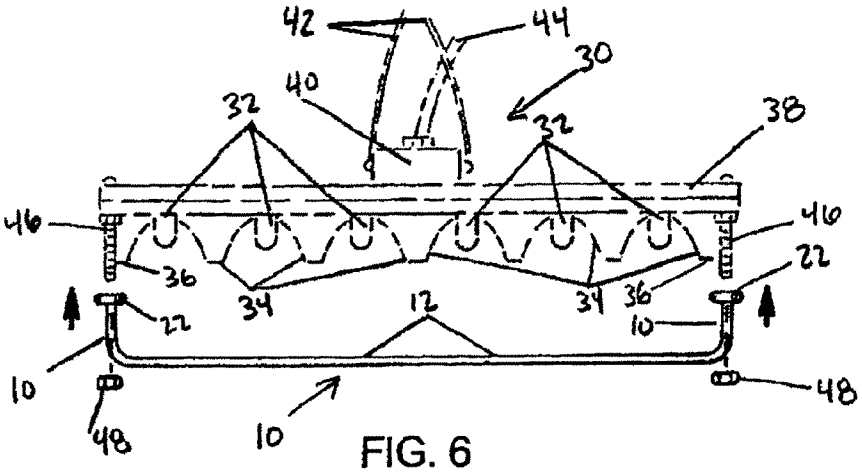
FIG. 6 is an end view of a fluorescent light fixture, with a rear view of the fluorescent lamp catcher of FIG. 1 positioned for mounting on the light fixture.
Figure 7:
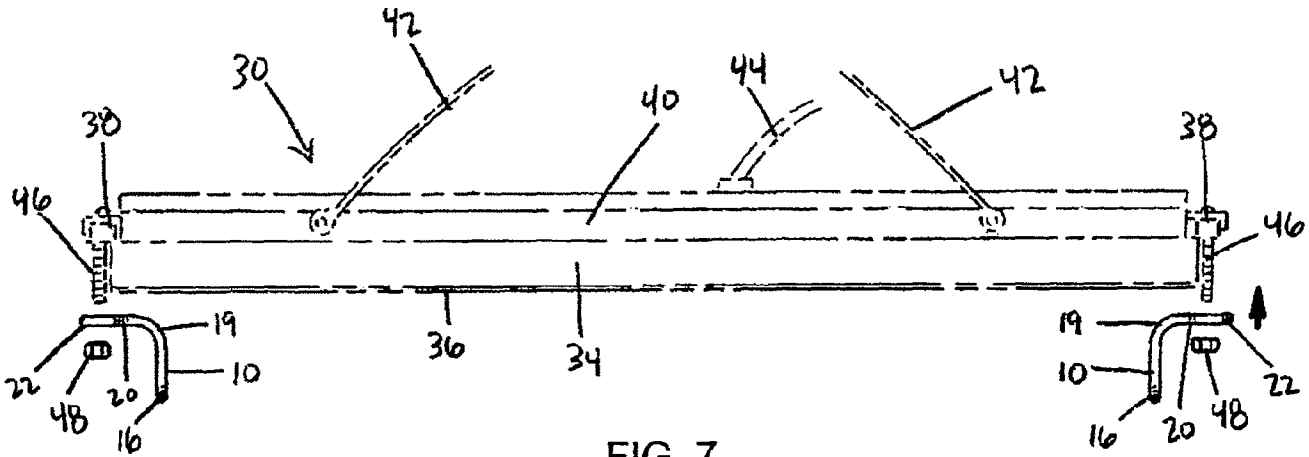
FIG. 7 is a side view of a fluorescent light fixture, with end views of two fluorescent lamp catchers of FIG. 1 positioned for mounting on the light fixture.

FIGS. 6-7 show the fluorescent lamp tube catcher 10 positioned for mounting on an exemplary light fixture 30. The light fixture 30 can have a so-called "I-beam" construction, which includes fluorescent lamp sockets 32, reflectors 34, and wiring (not shown) supported by a frame that can include two lateral frame members 38 at each end of a longitudinal frame member 40. The light fixture 30 can be suspended using suspension cables 42, and electrical power can be delivered to the fixture using a power supply cable 44. However, this particular structure is not required and other light fixture structures could be used.

As shown in FIGS. 6-7, the fluorescent lamp tube catcher 10 is positioned for mounting to the light fixture 30 by aligning the mounting portions 22 of the lamp tube catcher 10 with bolts 46 on the light fixture 30. After positioning the lamp tube catcher 10 on the bolts 46, a wrench can be used to tighten nuts 48 to secure the lamp tube catcher 10 on the bolts 46 and light fixture 30. The bolts 46 can be long enough that when the nuts 48 are loosened to near the end of the bolts 46, but not removed, this gives the tube catcher 10 enough freedom of movement to provide sufficient clearance to allow replacement of fluorescent lamps in the fixture without completely disengaging the tube catcher 10 from the fixture 30.

Figure 8:
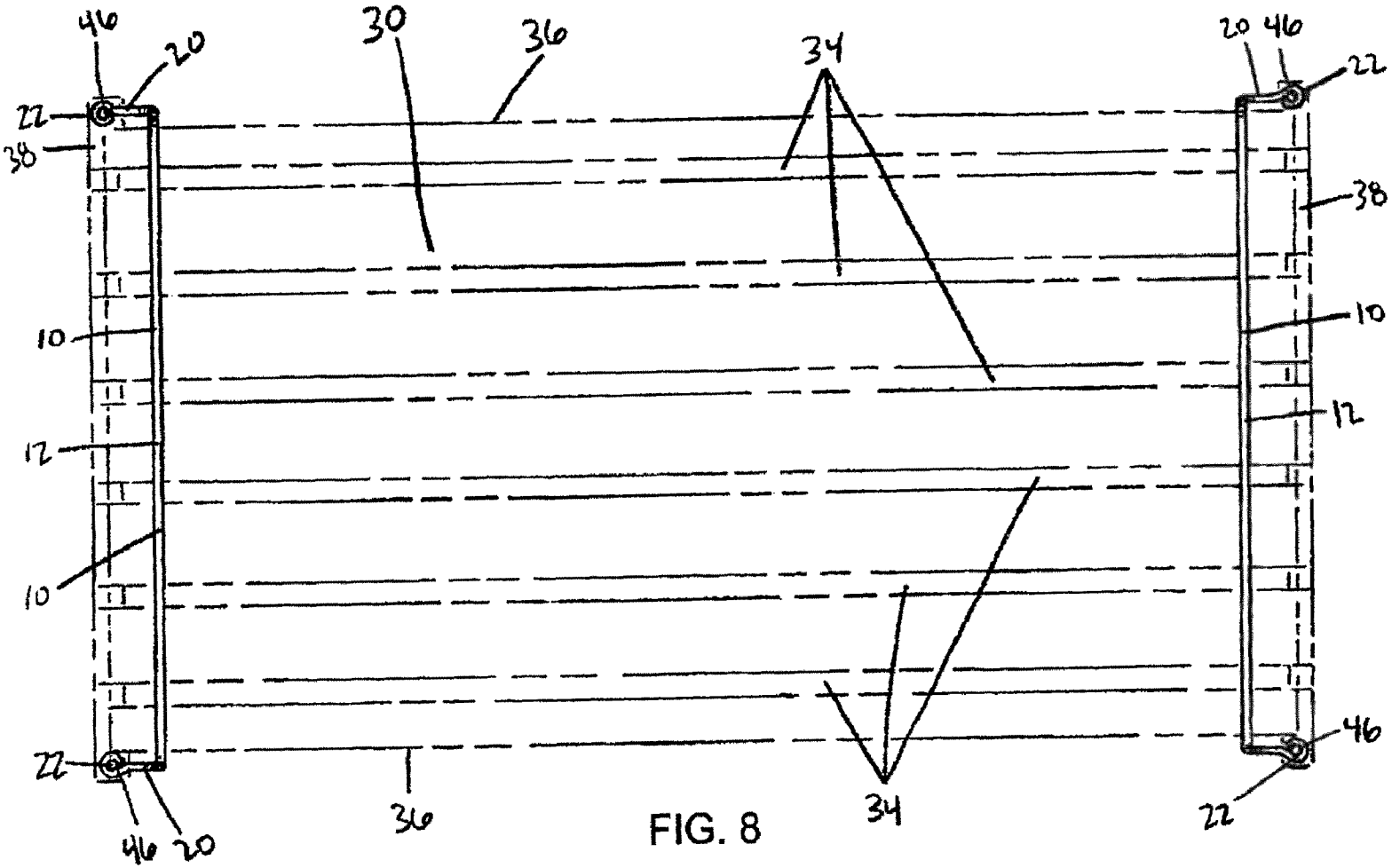
FIG. 8 is a bottom view of a fluorescent light fixture, with a bottom view of two fluorescent lamp catchers of FIG. 1 mounted on the light fixture.
Figure 9:
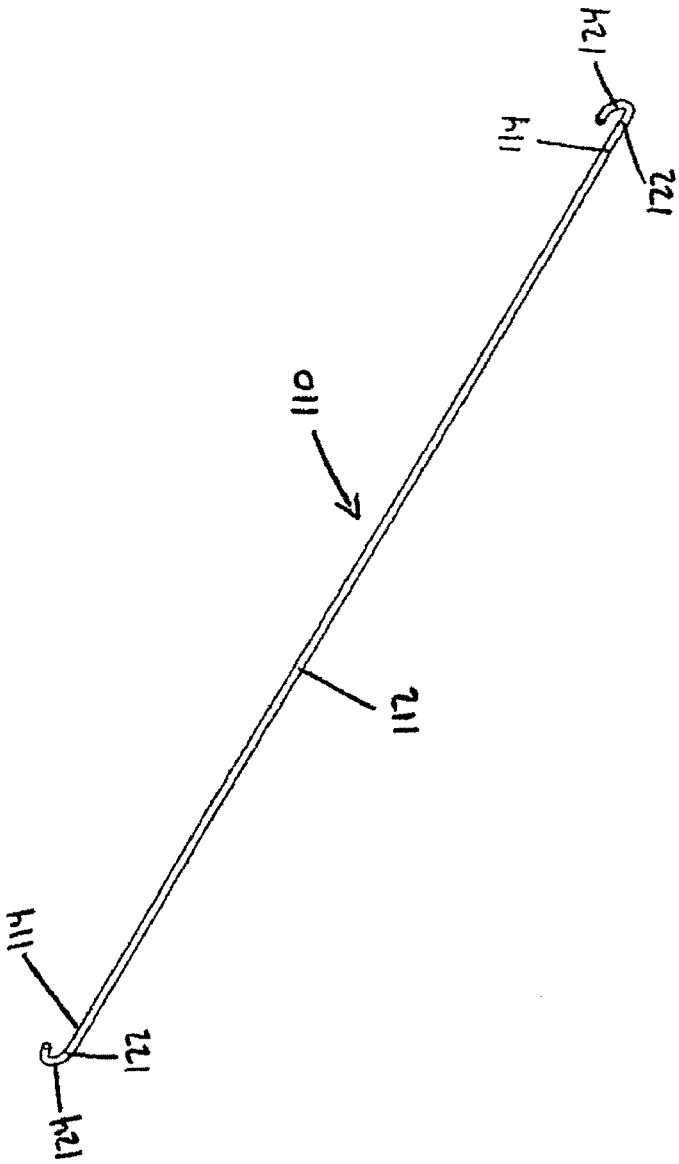
FIG. 9 is a perspective front view of a second embodiment of a fluorescent lamp catcher according to the invention.
Figure 10:
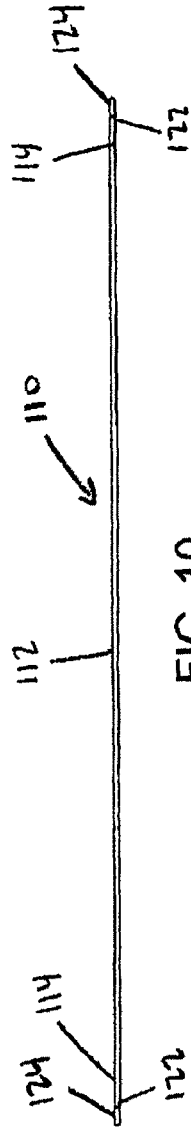
FIG. 10 is a top view of the fluorescent lamp catcher of FIG. 9.
Figure 11:
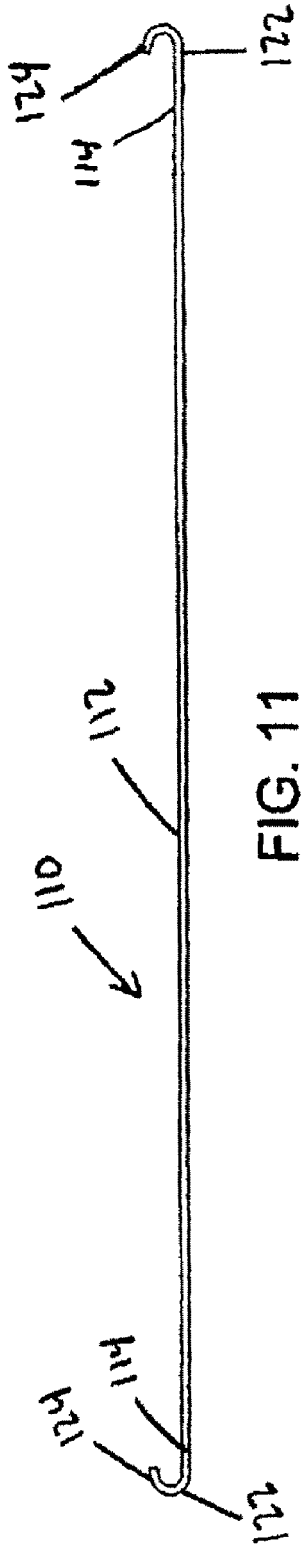
FIG. 11 is a front view of the fluorescent lamp catcher of FIG. 9.

FIG. 8 shows two fluorescent lamp tube catchers 10 positioned with their mounting portions 22 on the bolts 48 of a light fixture 30. The nuts 48 are not shown in FIG. 8 to avoid obscuring the mounting portions 22. As best shown in FIG. 8, the central portions 12 of the fluorescent lamp tube catchers 10 extend across the light fixture 30 between the reflector rims 36, whereby the lamp tube catchers are positioned to catch any lamp that may become loose.

Figure 12:
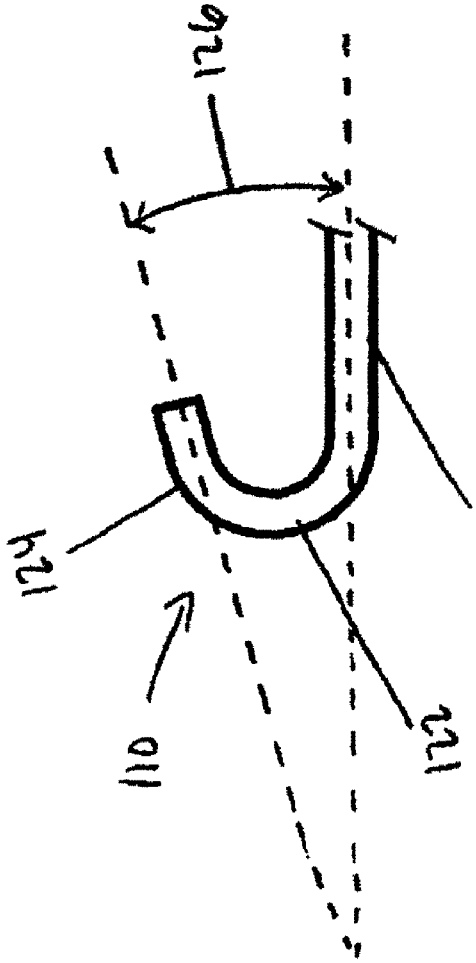
FIG. 12 is a side view of the fluorescent lamp catcher of FIG. 9.

FIGS. 9-12 provide various views of a second embodiment of a fluorescent lamp tube catcher according to the invention, indicated generally at 110. The light tube catcher 110 includes a substantially straight central portion 112 between two lateral portions 114. Each lateral portion 114 includes a mounting portion 122 that can be formed as a mounting hook 124. As best shown in FIG. 12, the mounting hook 124 can be formed with a mounting hook angle 126 of about 20 degrees. This particular structure is not required, and different structures could be used with different light fixture structures.

The light tube catcher 110 is preferably formed by bending a unitary piece of metal wire into the desired shape, as this can be a particularly cost-effective method. However, this is not required and other materials and methods of construction could be used. For example, a molded plastic or other synthetic part could be used, or a part formed of multiple pieces could be used.

Figure 13:
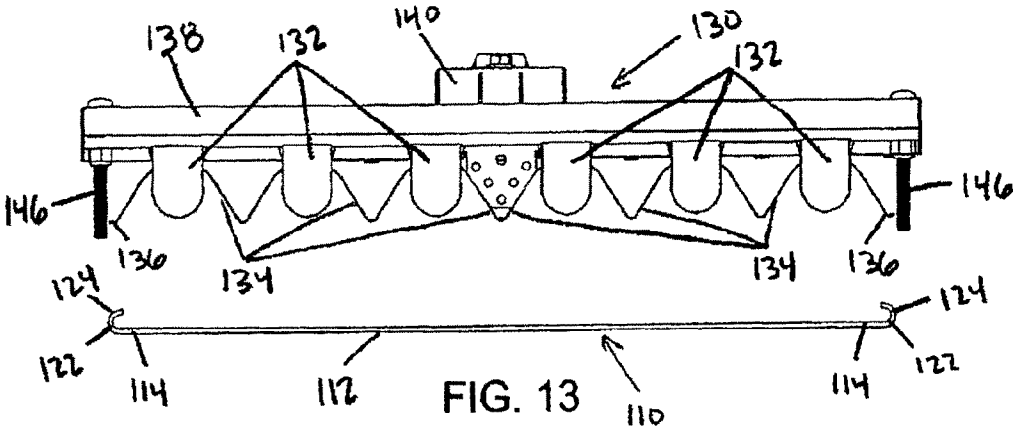
FIG. 13 is an end view of a fluorescent light fixture, with the fluorescent lamp catcher of FIG. 9 positioned for mounting on the light fixture.
Figure 14:
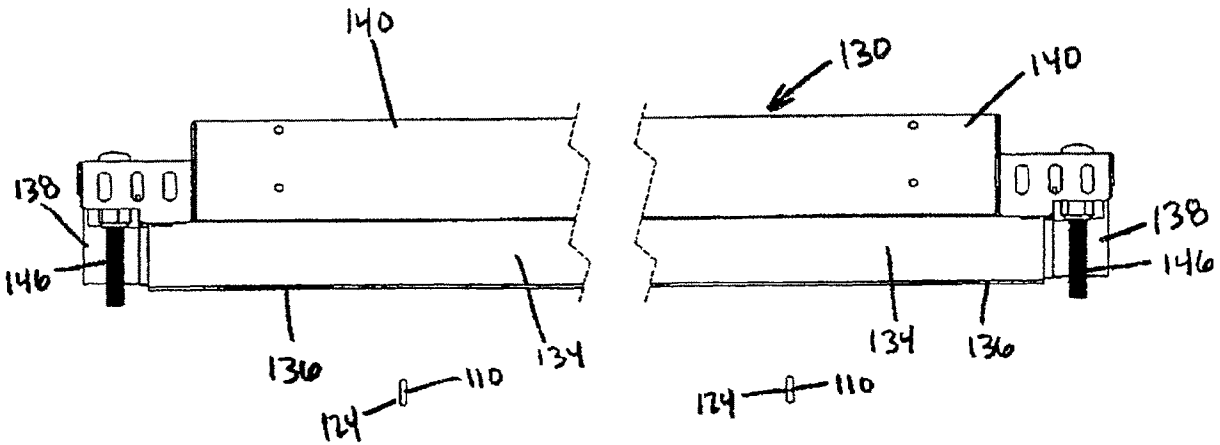
FIG. 14 is a side view of a fluorescent light fixture, with two fluorescent lamp catchers of FIG. 9 positioned for mounting on the light fixture.

FIGS. 13-14 show the fluorescent lamp tube catcher 110 positioned for mounting on an exemplary light fixture 130. The light fixture 130 can have a so-called "I-beam" construction, which includes fluorescent lamp sockets 132, reflectors 134, and wiring (not shown) supported by a frame that can include two lateral frame members 138 at each end of a longitudinal frame member 140. However, this particular structure is not required and other light fixture structures could be used.

Figure 15:
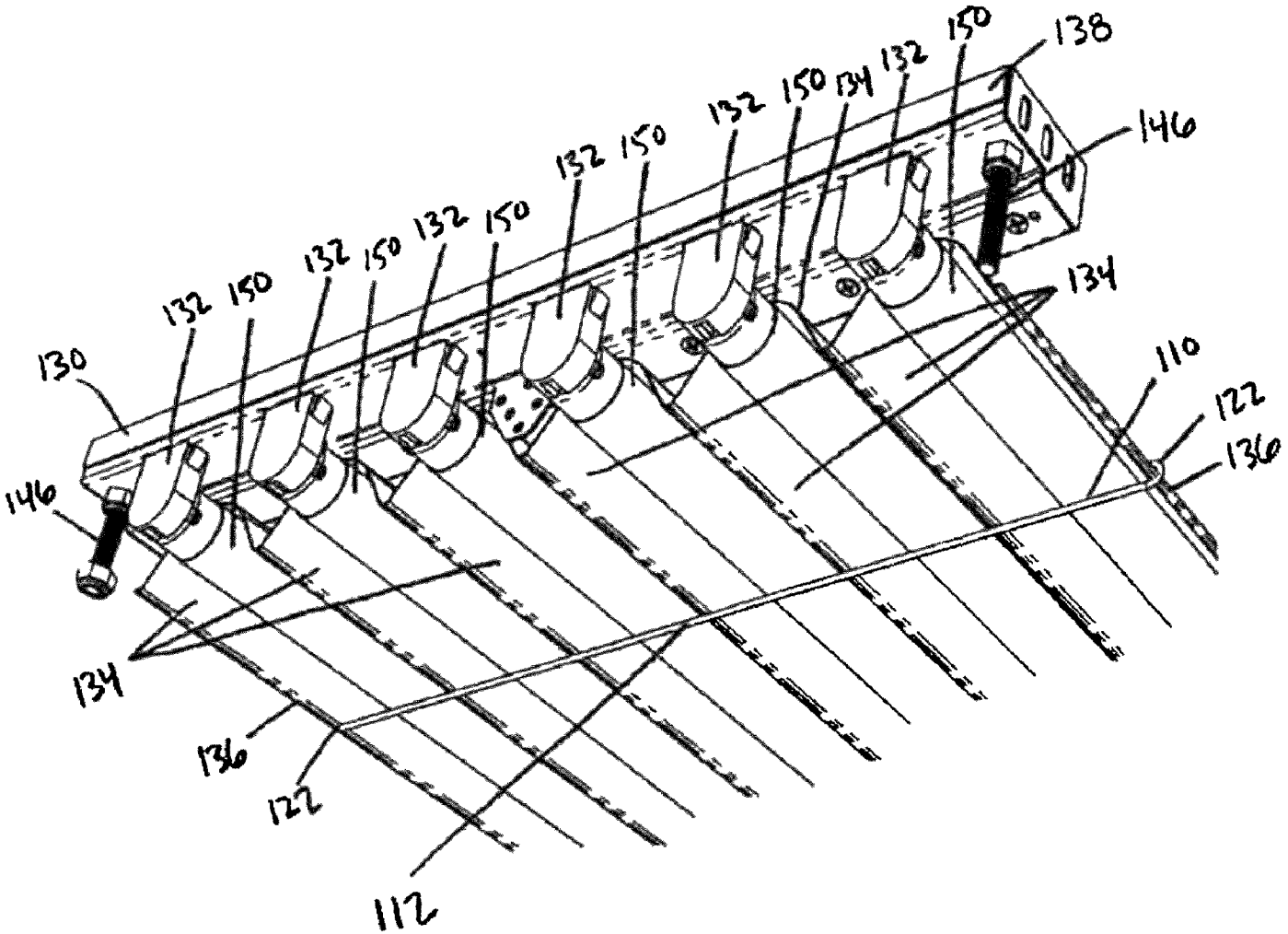
FIG. 15 is a bottom perspective view of one end of a fluorescent light fixture, with the fluorescent lamp catcher of FIG. 9 mounted on the light fixture.

As shown in FIGS. 13-14, the fluorescent lamp tube catcher 110 is positioned for mounting to the light fixture 130 by aligning the mounting portions 122 and mounting hooks 124 of the lamp tube catcher 110 above the lateral reflector rims 136 on the light fixture 130. After positioning the lamp tube catcher 110 above the lateral reflector rims 136, the mounting hooks 124 are clipped on a lateral structure on the light fixture, such as the reflector rims 136, to secure the lamp tube catcher 110 on the light fixture 130 as shown in FIG. 15. Importantly, this embodiment of a lamp tube catcher 110 can be clipped on and off the light fixture 130 without the use of tools, for example when it is necessary to replace a failed fluorescent lamp.

FIG. 15 shows one end of a fluorescent light fixture 130, with a fluorescent lamp tube catcher 110 secured to the light fixture 130 with the mounting hooks 124 of the lamp tube catcher 110 clipped on the lateral reflector rims 136 of the light fixture 130. As best shown in FIG. 15, the central portion 112 of the fluorescent lamp tube catcher 110 extends across the light fixture 130 between the reflector rims 136, whereby the lamp tube catcher 110 is positioned to catch any fluorescent lamp tube 150 which may become loose.

Figure 16A:
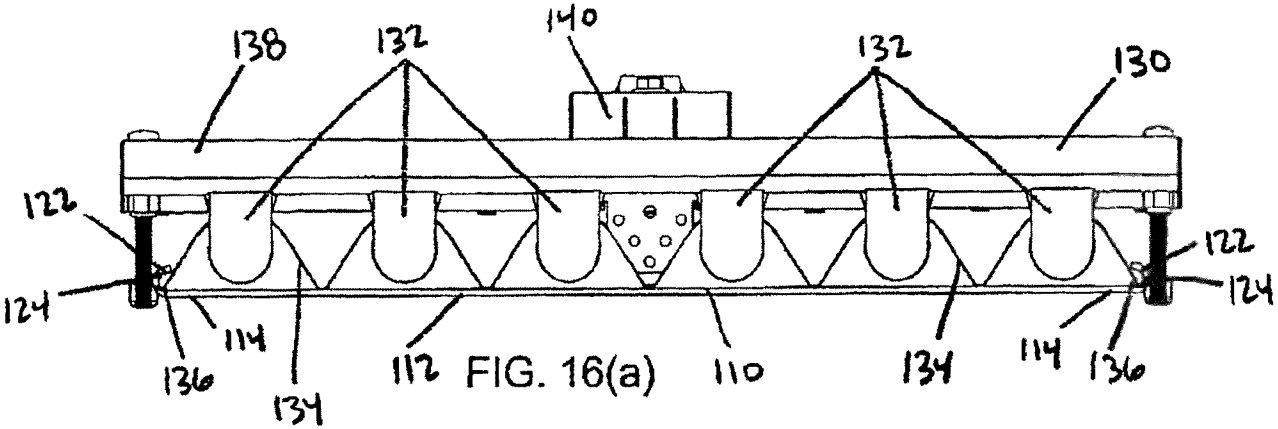
FIG. 16(*a*) is an end view of a fluorescent light fixture with the fluorescent lamp catcher of FIG. 9 mounted on the light fixture, and FIG. 16(*b*) is the same view but with one fluorescent lamp loosened from the light fixture and caught by the lamp catcher.
Figure 16B:
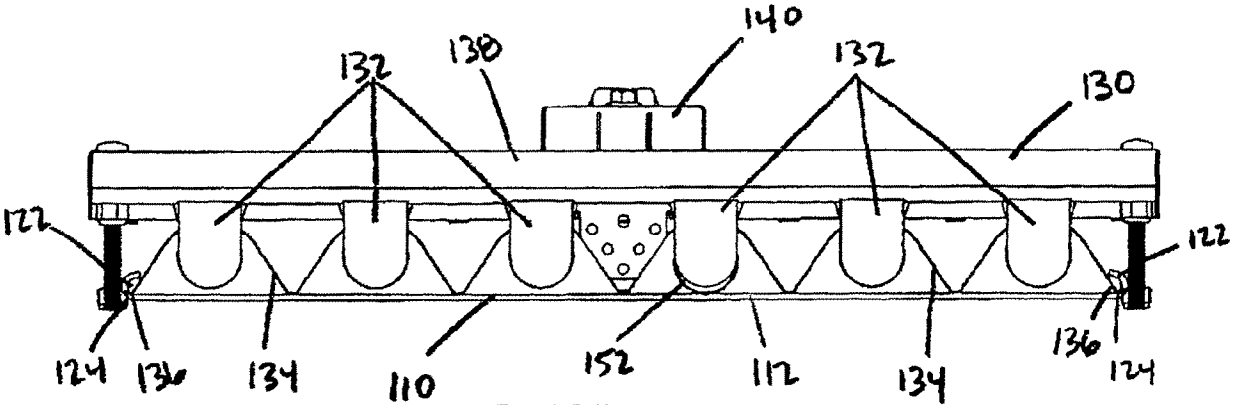
Figure 17:
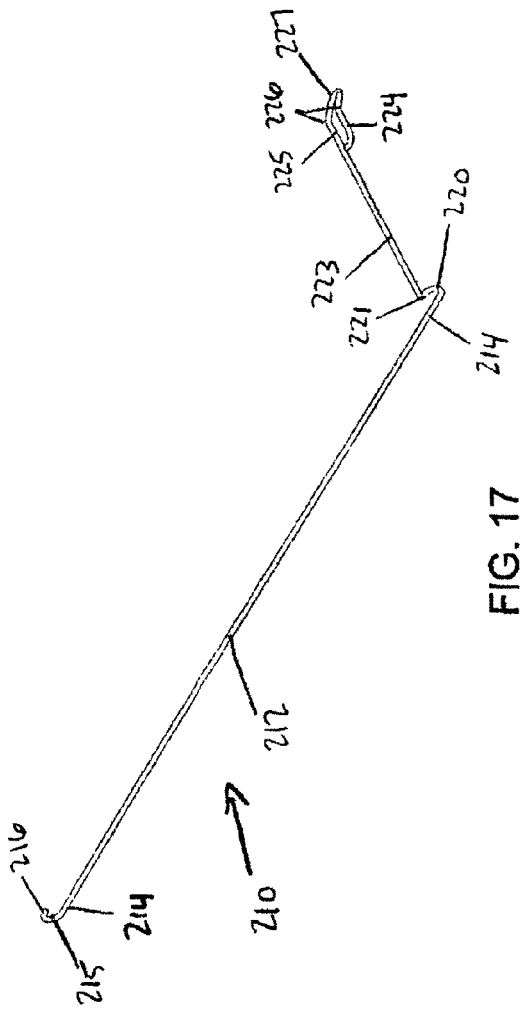
FIG. 17 is a perspective front view of a third embodiment of a fluorescent lamp catcher according to the invention.
Figure 18:
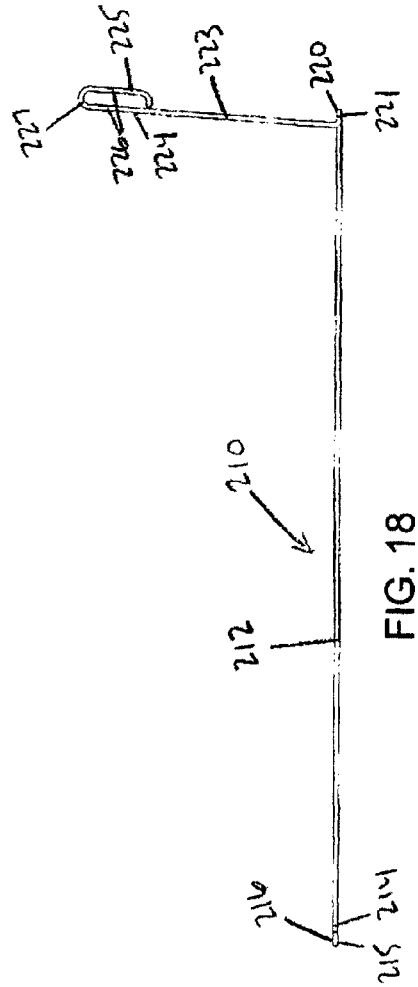
FIG. 18 is a top view of the fluorescent lamp catcher of FIG. 17.
Figures 19, 20, 21:
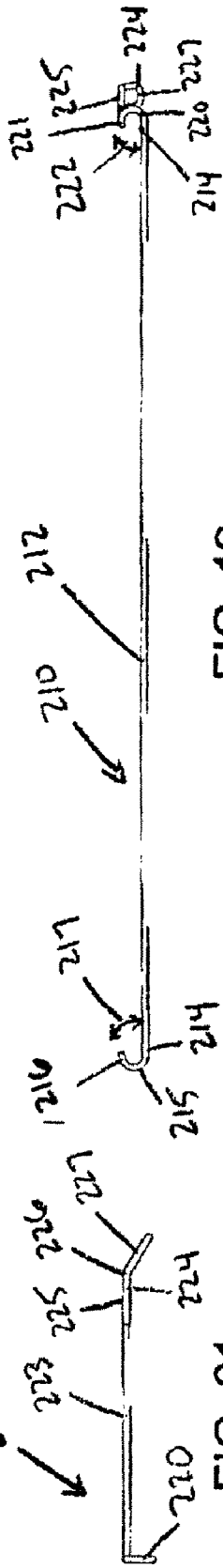
FIG. 19 is a front view of the fluorescent lamp catcher of FIG. 17.
FIG. 20 is a rear view of the fluorescent lamp catcher of FIG. 17.
FIG. 21 is a side view of the fluorescent lamp catcher of FIG. 17.

FIGS. 16(*a*) and 16(*b*) show how a fluorescent lamp tube catcher according to the invention, such as the fluorescent lamp tube catcher 110, can prevent a loosened fluorescent tube from falling. FIG. 16(*a*) is an end view of a fluorescent light fixture 130 with the fluorescent lamp tube catcher 110 mounted on the light fixture, and FIG. 16(*b*) is the same view but with one fluorescent lamp 152 loosened from the light fixture 130 and caught by the lamp catcher 110.

FIGS. 17-21 provide various views of a third embodiment of a fluorescent lamp tube catcher according to the invention, indicated generally at 210. The light tube catcher 210 includes a central portion 212 between lateral portions 214. The first lateral portion 214 includes a first mounting portion 215 with a first mounting hook 216 that has a first mounting hook angle 217 that is preferably about 20 degrees. In that regard, the first lateral portion 214 is similar to the lateral portions 114 of the light tube catcher 110.

The second lateral portion 214 of the lamp tube catcher 210 also includes a second mounting portion 220 with a second mounting hook 221 that has a second mounting hook angle 222 that is preferably about 20 degrees. In the lamp tube catcher 210, the second lateral portion 214 is connected to a retainer offset portion 223 to a retainer portion 224. The retainer portion 224 can have a retainer proximal portion 225, a retainer portion bend 226, and a retainer distal portion 227. This particular structure is not required, and different structures could be used with different light fixture structures.

The light tube catcher 210 is preferably formed by bending a unitary piece of metal wire into the desired shape, as this can be a particularly cost-effective method. However, this is not required and other materials and methods of construction could be used. For example, a molded plastic or other synthetic part could be used, or a part formed of multiple pieces could be used.

Figure 22:
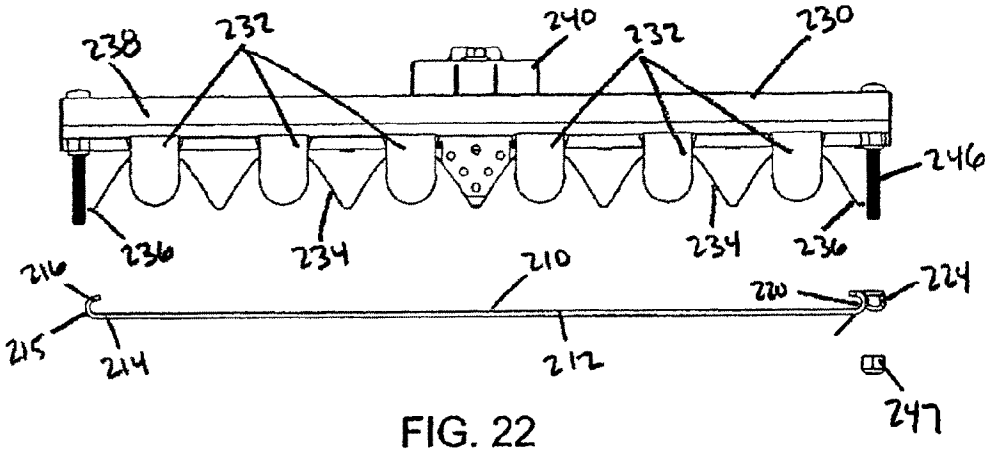
FIG. 22 is an end view of a fluorescent light fixture, with the fluorescent lamp catcher of FIG. 17 positioned for mounting on the light fixture.
Figure 23:
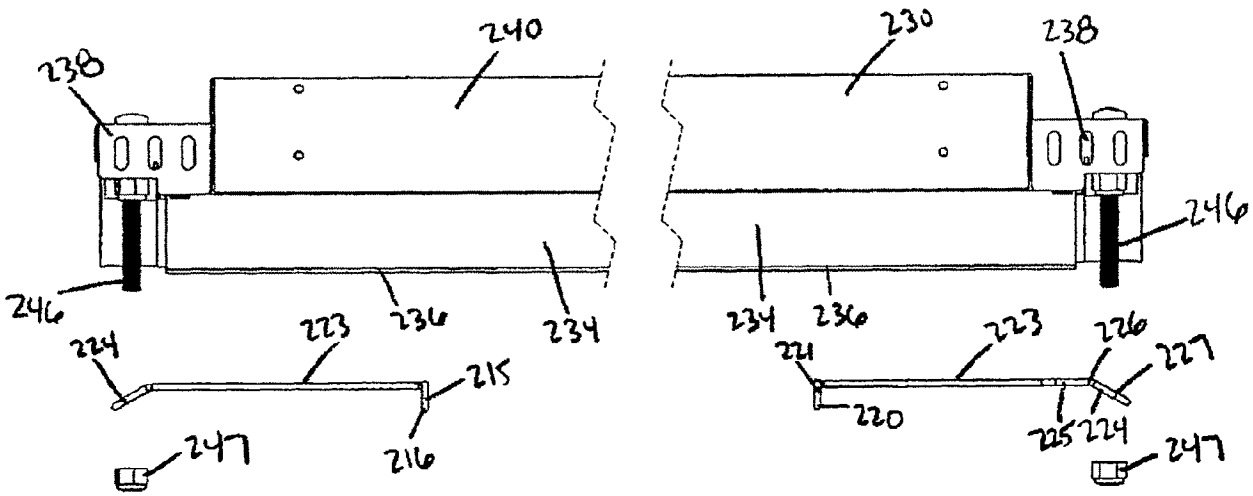
FIG. 23 is a side view of a fluorescent light fixture, with two fluorescent lamp catchers of FIG. 17 positioned for mounting on the light fixture.

FIGS. 22-23 show the fluorescent lamp tube catcher 210 positioned for mounting on a light fixture 230. The light fixture 230 can have a so-called "I-beam" construction, which includes a plurality of fluorescent lamp sockets 232, one or more reflectors 234, and wiring (not shown) supported by a frame that includes two lateral frame members 238 at each end of a longitudinal frame member 240. However, this particular structure is not required and other light fixture structures could be used.

As shown in FIGS. 22-23, the fluorescent lamp tube catcher 210 is positioned for mounting to the light fixture 230 by aligning the retainer portion 224 above a bolt 246 on the light fixture 230. Once aligned, the retainer portion 224 can be moved onto the bolt 246, with the bolt 246 through the retainer portion 224. Once the retainer portion 224 is on the bolt 246, a nut 247 can be loosely tightened on the bolt 246 to loosely retain the lamp tube catcher 210 on the bolt 246.

Once the lamp tube catcher 210 is loosely retained on the light fixture 230 in this fashion, the lamp tube catcher 210 can be positioned above the lateral reflector rims 236. Next, the first mounting portion 215 and first mounting hook 216 can be clipped on the far reflector rim 236 to secure that free end of the lamp tube catcher 210 to the light fixture 230. Finally, the second mounting portion 220 and second mounting hook 216 can be clipped on the near reflector rim 236 to finish securing the lamp tube catcher 210 to the light fixture 230.

This embodiment of a lamp tube catcher 210 can be clipped on and off the light fixture 230 without the use of tools, for example when it is necessary to replace a failed fluorescent lamp, while loosely retaining the lamp tube catcher 210 on the light fixture 230. Because the lamp tube catcher 210 is loosely retained at only one end, the bolt 246 forms a pivot point so the tube catcher 210 can be rotated well away from the light fixture 230 to provide excellent clearance while replacing a fluorescent lamp. Because the tube catcher 210 is loosely retained on the light fixture 230, there is no risk that the tube catcher 210 will fall to the ground, or any need to find a place to put the tube catcher 210, while at the top of a ladder replacing a fluorescent lamp. Because the retainer portion 224 can freely travel along the shaft of the bolt 246 while loosely retained by the nut 247, the lamp tube catcher 210 has excellent freedom of movement about the pivot point of the bolt 246.

Figure 24:
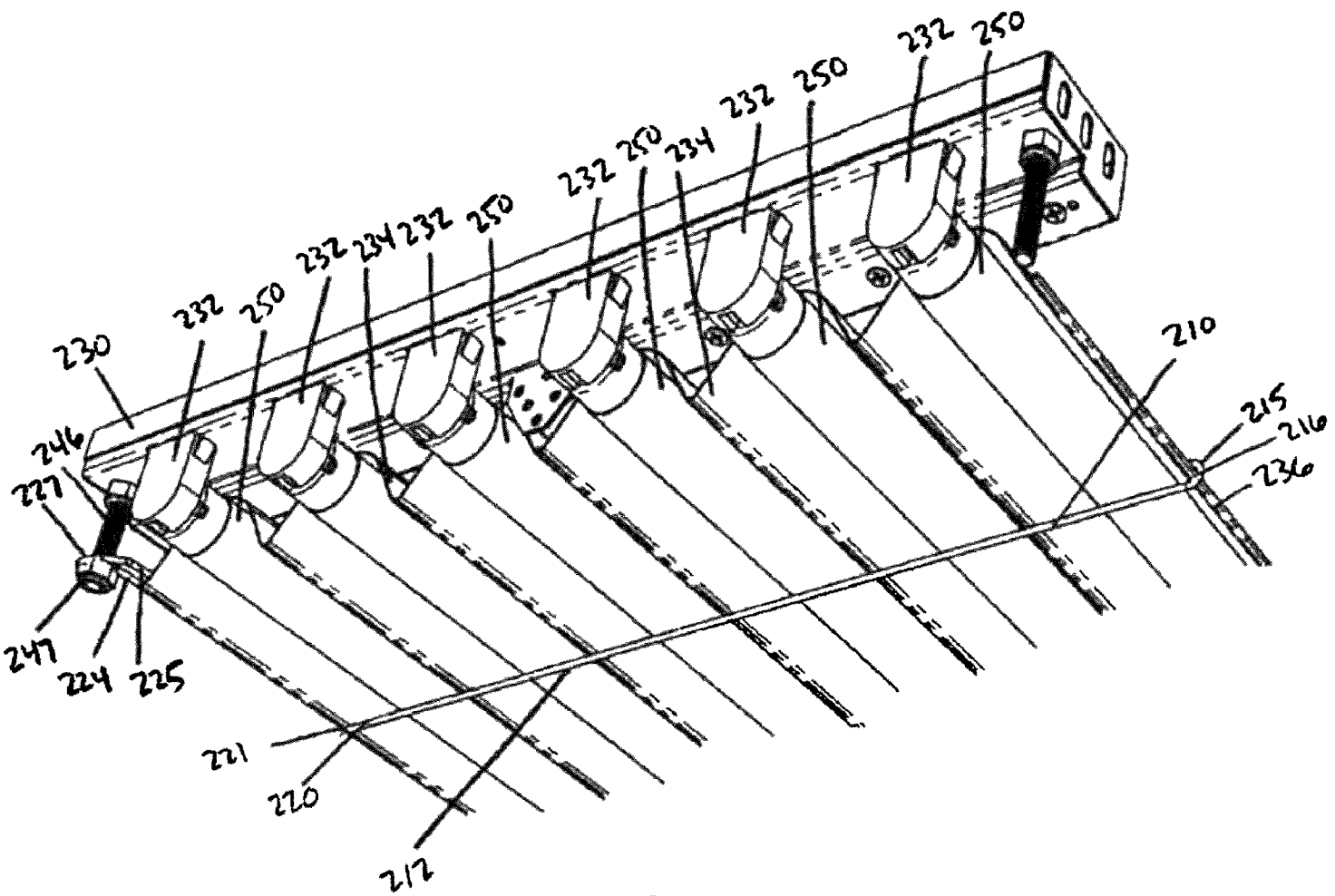
FIG. 24 is a bottom perspective view of one end of a fluorescent light fixture, with the fluorescent lamp catcher of FIG. 17 mounted on the light fixture.

FIG. 24 shows one end of a fluorescent light fixture 230, with a fluorescent lamp tube catcher 210 clipped on the lateral reflector rims 236 of the light fixture 230 and with the lamp tube catcher 210 loosely retained on the light fixture 230. As best shown in FIG. 24, the central portion 212 of the fluorescent lamp tube catcher 210 extends across the light fixture 230 between the reflector rims 236, whereby the lamp tube catcher 210 is positioned to catch any fluorescent lamp tube 250 which may become loose.

Figure 25A:
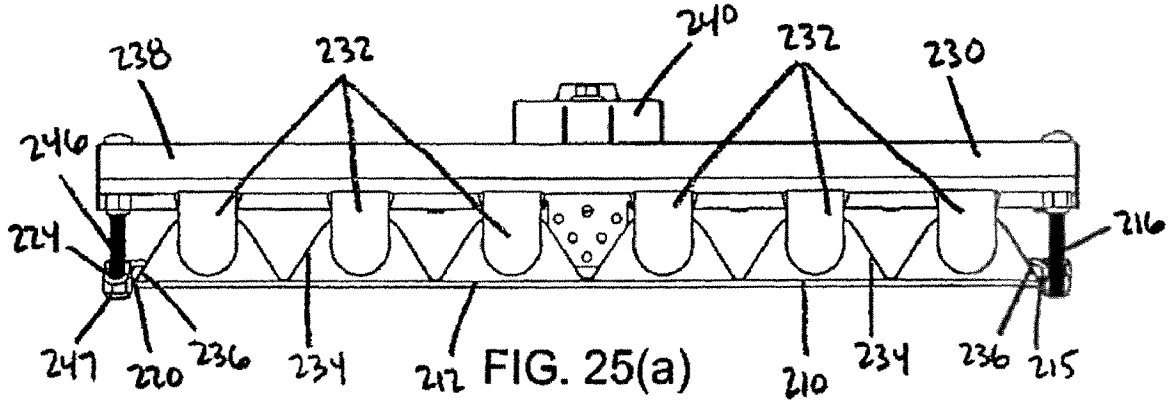
FIG. 25(*a*) is an end view of a fluorescent light fixture with the fluorescent lamp catcher of FIG. 17 mounted on the light fixture, and FIG. 25(*b*) is the same view but with one fluorescent lamp loosened from the light fixture and caught by the lamp catcher.
Figure 25B:
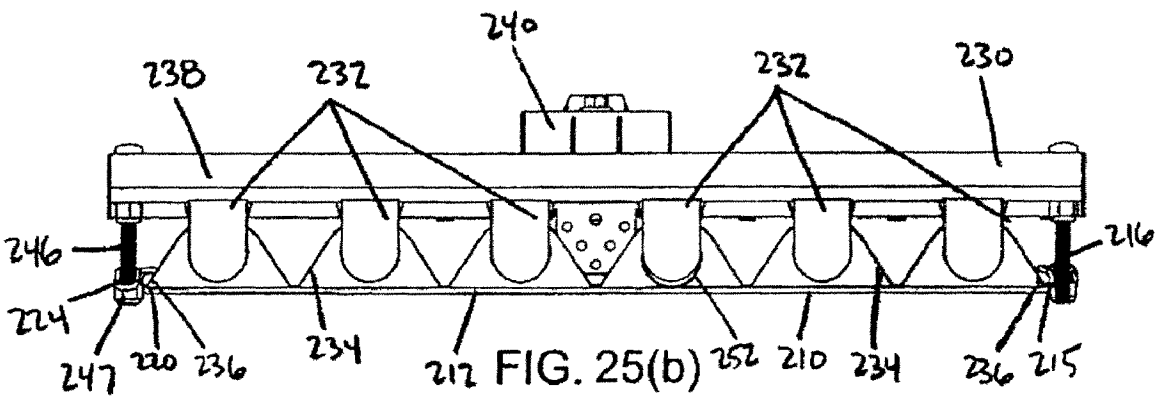

FIGS. 25(*a*) and 25(*b*) show how a fluorescent lamp tube catcher according to the invention, such as the fluorescent lamp tube catcher 210, can prevent a loosened fluorescent tube from falling. FIG. 25(*a*) is an end view of a fluorescent light fixture with the fluorescent lamp tube catcher 210 mounted on the light fixture, and FIG. 25(*b*) is the same view but with one fluorescent lamp 252 loosened from the light fixture 230 and caught by the lamp catcher 210.

Figure 26:
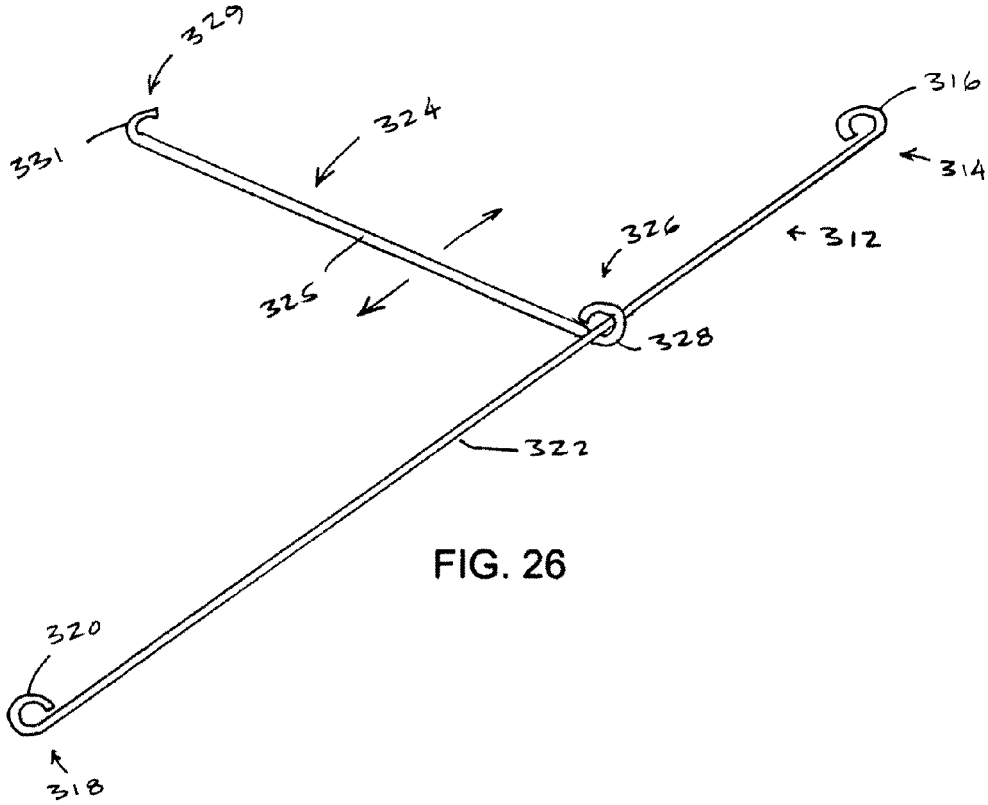
FIG. 26 is a top perspective view of a fourth embodiment of a fluorescent lamp catcher according to the invention.
Figure 27:
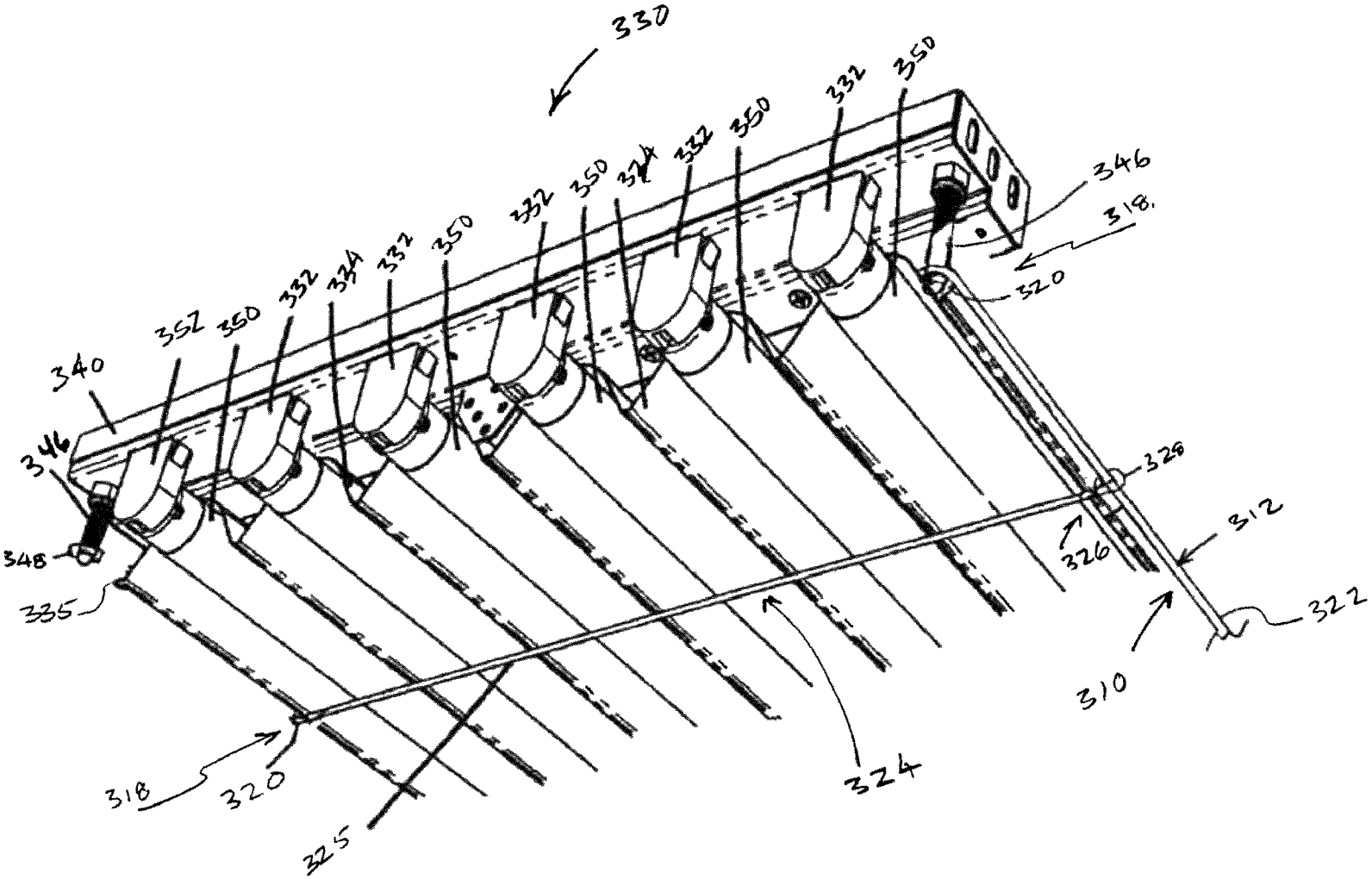
FIG. 27 is a bottom perspective view of one end of a fluorescent light fixture, with the fluorescent lamp catcher of FIG. 26 mounted on the light fixture.

Referring to FIGS. 26-27, another embodiment of a lamp catcher for a fluorescent light fixture 330 is shown according to an exemplary embodiment, and is indicated generally at 310. The light tube catcher 310 includes a first elongated wire member 312 having a central portion 322 extending between a first end portion 318 and a second end portion 314. The first end portion 318 includes a first mounting portion shown as a first mounting loop 320 (which could also be provided as a hook or the like) and the second end portion 314 includes a second mounting portion shown as a second mounting loop 316 (which could also be provided as a hook or the like). According to one embodiment, the first and second mounting loops 320, 316 comprise an internal diameter within the range of approximately 0.260-0.312 inches, however, other suitable dimensions may be used to suit other embodiments. The length of the first elongated wire member 312 may be provided with any suitable dimensions. According to one embodiment, the length of the first elongated wire member 312 is within the range of approximately 40-50 inches and more particularly approximately 46.875 inches from the center of the first mounting loop 320 to the center of the second mounting loop 316, however, other suitable dimensions may be used to suit other embodiments. The first elongated wire member 312 may be formed from any suitable material. According to one embodiment, the first elongated wire member 312 is formed from galvanized steel wire having a diameter within a range of approximately 0.09375-0.125 inches, however, other materials and sizes may be used to suit other embodiments.

The light tube catcher 310 also includes a second elongated wire member 324 having a central portion 325 extending between a first end portion 326 and a second end portion 329. The first end portion 326 includes a first mounting portion shown as a mounting loop 328 (which could also be provided as a hook or the like) and the second end portion 329 includes a second mounting portion shown as a hook 331. According to one embodiment, the hook 331 comprises a hook angle within a range of approximately 10-20 degrees, and more particularly approximately 15 degrees, with a hook leg extending a distance of approximately 0.346 inches, and the mounting loop 328 comprises an internal diameter within the range of approximately 0.125-0.250 inches, however, other suitable dimensions may be used to suit other embodiments. The length of the second elongated wire member 324 may be provided with any suitable dimensions. According to one embodiment, the length of the second elongated wire member 324 is within the range of approximately 6-29 inches, however, other suitable dimensions may be used to suit other embodiments. The second elongated wire member 324 may be formed from any suitable material. According to one embodiment, the second elongated wire member 324 is formed from galvanized steel wire having a diameter within a range of approximately 0.09375-0.125 inches, however, other materials and sizes may be used to suit other embodiments.

The first and second elongated wire members 312, 324 of the light tube catcher 310 are preferably formed by bending a unitary piece of metal wire into the desired shape, as this can be a particularly cost-effective method. However, this is not required and other materials and methods of construction could be used. For example, a molded plastic or other synthetic part could be used, or a part formed of multiple pieces could be used.

FIG. 27 shows the fluorescent lamp tube catcher 310 positioned for mounting on a light fixture 330. The light fixture 330 can have a so-called "I-beam" construction, which includes a plurality of first fluorescent lamp sockets 332 supported by a first frame portion 340, one or more reflectors 334 having an outwardly extending rim or lip 335, and wiring (not shown), and a plurality of second fluorescent lamp sockets supported by a second frame portion (as previously described with reference to prior embodiments and not shown in FIG. 27 for clarity). However, this particular structure is not required and other light fixture structures could be used. Each frame portion is shown to include a threaded member 346 proximate each end of the frame portion 340.

As shown in FIGS. 26-27, the fluorescent lamp tube catcher 310 is prepared for mounting to the light fixture 330 by assembling the first elongated wire member 312 and the second elongated wire member 324 together so that the loop 328 of the second elongated wire member 324 is disposed about the central portion 322 of the first elongated wire member 312, so that the second elongated wire member 324 is slidable along the length of the first elongated wire member 312. The assembly may be accomplished by inserting the first elongated wire member 312 through the loop 328 of the second wire member 324 before one or both of the loops 320, 316 on the first elongated wire member 312 are formed. Alternatively, the loop 328 on the second elongated wire member 324 can be formed about the central portion 322 of the first elongated wire member 312.

The first and second mounting loop portions 320, 316 of the first elongated wire member 312 are mounted upon (or otherwise operably coupled to) the threaded member 346 on a first side of the first and second frame members 340 (second frame member is substantially opposite and identical to the first frame member—not shown for clarity) so that the first elongated wire member 312 is supported adjacent to reflector 334 and extends substantially parallel to a longitudinal axis of reflector 334. Once the mounting loop portions 320, 316 are engaged with the threaded members 346, a nut 348 can be loosely tightened on the threaded member 346 of each of the first and second frame portions to loosely retain the first elongated wire member 312 on the fixture 330.

Once the first elongated wire member 312 of the lamp tube catcher 310 is retained on the light fixture 330 in this fashion, one or more of the second elongated wire member 324 of the lamp tube catcher 310 can be positioned at any desired location along the length of the fixture 330 between the first and second frame members 340 and the hook 331 can be slidably clipped on the lip or rim 335 of the reflector 334 at the opposite side of the fixture 330 to secure that free end 329 of the second elongated wire member 324 to the light fixture 330. The lamp tube catcher 310 may include one or more of the second elongated wire members 324 that, once installed, are slidable along the length of the fixture 330 to any desired location.

This embodiment of a lamp tube catcher 310 provides a second wire member 324 that can be easily clipped on and off (and slid back and forth along) the light fixture 330 without the use of tools, for example when it is necessary to replace a failed fluorescent lamp 350. Because the second wire member 324 is retained by the first wire member 312 on the light fixture 330, there is no risk that the second wire member 324 will fall to the ground, or any need to find a place to put the second wire member 324, while at the top of a ladder replacing a fluorescent lamp 350. Because the second wire member 324 can freely travel along the length of the first wire member 312, the second wire member 324 has excellent freedom of movement on the fixture 330.

As best shown in FIG. 27, the central portion 325 of the second wire member(s) 324 extend across (e.g. substantially perpendicular to the longitudinal axis of the reflector 334), whereby the second wire member(s) 324 are positioned to catch any fluorescent lamp tube 350 which may become loose. The central portion 325 of the second wire member 324 may be provided as a substantially straight member extending between the loop 328 and the hook 331, however, the central portion may also be provided in any one or more of a variety of shapes intended to provide enhances capture protection for a lamp tube that becomes loose (or otherwise disengages) from the lamp holders or frame members.

There are various possibilities with regard to alternative embodiments and methods including a fluorescent lamp tube catcher according to the invention.

Although the preferred embodiments according to the invention disclosed herein are formed by bending a unitary piece of wire into the desired shape, other constructions could be used. For example, a flat strap of material could be bent into the desired shape and used instead of a wire. Also, it is not required that the device be formed by bending—any suitable process known in the art such as molding, thermoforming, stamping, or extruding could be used.

Similarly, although the preferred embodiments disclosed herein include mounting portions that are formed as bent loops that engage bolts on a light fixture or hooks of wire that engage lateral reflector rims, other mounting portion structures could be used. The phrase "at least a portion of a loop" means either an entire loop, a portion of a loop, or a hook. For example, a slot could be formed in a flat strap of material, with the slot positioned to be clipped on a lateral reflector rim or other structure. Alternatively, the mounting portion could be a straight wire or strap end that could be inserted into a hole or slot in a portion of the light fixture.

It is not necessary that there be exactly two mounting portions or that the mounting portion or portions be secured to the light fixture at or near the lateral edges of the light fixture. If a retainer portion is provided on the lamp tube catcher, a retainer offset portion is not required. If a retainer offset portion is provided, it can be a unitary part of the lamp tube catcher, or it can be a cord, chain, or cable that connects the retainer portion to the remainder of the lamp tube catcher.

It is understood that the invention is not confined to the embodiments set forth herein as illustrative, but embraces all such forms thereof that come within the scope of the following claims.

What is claimed is:

1. A fluorescent light fixture with lamp tube catcher, comprising:

a first frame portion supporting at least one first lamp socket;

a second frame portion supporting at least one second lamp socket;

at least one reflector defining a longitudinal axis and extending between the first frame portion and the second frame portion, and configured to reflect light emitted from a fluorescent lamp tube extending between the first lamp socket and the second lamp socket;

a first edge extending substantially along the length of the reflector on a first side of the light fixture and a second edge extending substantially along the length of the reflector on a second side of the light fixture;

an elongated wire member having a first end defining a first hook and a second end defining a second hook, the first hook slidably coupled to the reflector along the first edge and the second hook slidably coupled to the reflector along the second edge, so that the elongated wire member may be disposed at any one of a plurality of locations along the length of the reflector.

2. The fixture of claim 1 wherein the elongated wire member is formed by bending a unitary piece of wire.

3. The fixture of claim 2 wherein the first and second hooks comprise a hook angle of about 20 degrees.

4. The fixture of claim 1 wherein the elongated wire member defines a substantially straight line between the first end and the second end.

5. A fluorescent light fixture with lamp tube catcher, comprising:

a first frame portion supporting at least one first lamp socket, the first frame portion having a first side with a first threaded member and a second side with a second threaded member;

a second frame portion supporting at least one second lamp socket;

at least one reflector defining a longitudinal axis and extending between the first frame portion and the second frame portion, and configured to reflect light emitted from a fluorescent lamp tube extending between the first lamp socket and the second lamp socket;

an elongated wire member having a first end defining a first loop removably supported by the first threaded member and a second end defining a second loop removably supported by the second threaded member, the elongated wire member including a central portion extending between the first end and the second end and configured to support the fluorescent lamp tube in the event that the fluorescent lamp tube disengages from one of the lamp sockets.

6. The fixture of claim 5 wherein the elongated wire member is formed by bending a unitary piece of wire.

7. The fixture of claim 5 wherein the second frame portion comprises a first side with a first threaded member and a second side with a second threaded member.

8. The fixture of claim 7 further comprising a second elongated wire member having a first end defining a first loop removably supported by the first threaded member on the second frame portion and a second end defining a second loop removably supported by the second threaded member on the second frame portion, the second elongated wire member including a central portion extending between the first end and the second end and configured to support the fluorescent lamp tube in the event that the fluorescent lamp tube disengages from the second lamp socket.

9. The fixture of claim 8 wherein the central portion of each of the elongated wire members includes first and second legs extending substantially parallel to the longitudinal axis and a mid portion extending between the first and second legs and substantially perpendicular to the longitudinal axis.

10. A fluorescent light fixture with lamp tube catcher, comprising:

a first frame portion having a first side and a second side, and supporting at least one first lamp socket;

a second frame portion having a first side and a second side and supporting at least one second lamp socket;

at least one reflector defining a longitudinal axis and extending between the first frame portion and the second frame portion, and configured to reflect light emitted from a fluorescent lamp tube extending between the first lamp socket and the second lamp socket;

an edge extending substantially along the length of at least one side of the reflector;

a first elongated wire member extending substantially parallel to the longitudinal axis and having a first end coupled to the first end of the first frame portion and a second end coupled to the second end of the second frame portion; and a second elongated wire member having a first end defining a loop disposed about the first elongated wire member for slidable engagement along at least a portion of the length of the first elongated wire member, and a second end defining a hook slidably coupled to the reflector along the edge, so that the second elongated wire member may be disposed at any one of a plurality of locations between the first frame portion and the second frame portion.

11. The fixture of claim 10 wherein the first frame portion includes a first threaded member and the second frame portion includes a second threaded member.

12. The fixture of claim 11 wherein the first end of the first elongated wire member defines a first loop supported by the first threaded member and the second end of the first elongated wire member defines a second loop supported by the second threaded member.

13. The fixture of claim 10 wherein the first and second elongated wire members are each formed by bending a unitary piece of wire.

14. The fixture of claim 10 wherein the hook comprises a hook angle of about 20 degrees.

15. The fixture of claim 10 wherein the first and second elongated wire members each define a substantially straight line between the first end and the second end.

16. A fluorescent light fixture with lamp tube catcher, comprising:

a first frame portion supporting at least one first lamp socket, the first frame portion having a first side with a first threaded member and a second side with a second threaded member;

a second frame portion supporting at least one second lamp socket;

at least one reflector defining a longitudinal axis and extending between the first frame portion and the second frame portion, and configured to reflect light emitted from a fluorescent lamp tube extending between the first lamp socket and the second lamp socket;

an elongated wire member having a first end defining a loop rotatably secured on the first threaded member and a second end defining a hook removably coupled to the second threaded member, the elongated wire member including a central portion extending between the first end and the second end and configured to support the fluorescent lamp tube in the event that the fluorescent lamp tube disengages from one of the lamp sockets.

17. The fixture of claim 16 wherein the elongated wire member is formed by bending a unitary piece of wire.

18. The fixture of claim 17 wherein the second frame portion comprises a first side with a first threaded member and a second side with a second threaded member.

19. The fixture of claim 18 further comprising a second elongated wire member having a first end defining a loop rotatably secured on the first threaded member of the second frame portion and a second end defining a hook removably coupled to the second threaded member of the second frame portion, the second elongated wire member including a central portion extending between the first end and the second end and configured to support the fluorescent lamp tube in the event that the fluorescent lamp tube disengages from the second lamp socket.

20. The fixture of claim 19 wherein the central portion of each of the elongated wire members includes first and second legs extending substantially parallel to the longitudinal axis and a mid portion extending between the first and second legs and substantially perpendicular to the longitudinal axis.

* * * * *